United States Patent [19]

Adkins

[11] 4,361,132

[45] Nov. 30, 1982

[54] STOVE BURNER APPARATUS

[76] Inventor: Arlene F. Adkins, 3027 N. Alta Vista Dr., Flagstaff, Ariz. 86001

[21] Appl. No.: 280,944

[22] Filed: Jul. 6, 1981

[51] Int. Cl.[3] ..... F24C 15/10; B65D 43/18

[52] U.S. Cl. ..... 126/221; 220/336

[58] Field of Search ..... 220/336; 126/220, 221, 126/214 R, 214 D, 299 C, 211, 216, 37 A, 37 B

[56] References Cited

U.S. PATENT DOCUMENTS 2,329,520 9/1943 Duberstein ..... 120/220

2,827,846 3/1958 Karkling ..... 126/299 C

*Primary Examiner*—James C. Yeung

*Assistant Examiner*—G. Anderson

*Attorney, Agent, or Firm*—H. Gordon Shields

[57] ABSTRACT

Stove burner apparatus includes four panels secured together and selectively movable to cover or to uncover one or more stove burners.

7 Claims, 6 Drawing Figures

STOVE BURNER APPARATUS

BACKGROUND OF THE INVENTION

1. Field of the Invention

This invention relates to stove covers, and, more particularly, to covers for stove top burners.

2. Description of the Prior Art

A typical or contemporary stove top, either gas or electric, generally includes four burners. The burners are usually arranged in a symmetrical configuration. For electric ranges, the burners may not be the same size, with respect to the diameter of the burners, but the organization of the burners with respect to the stove top is still generally symmetrical, with each burner being allocated about one-fourth of the overall area of the stove top.

While cooking, it is not uncommon for spilling, splattering, or the like, to take place. The result is somewhat of a messy stove top and a requirement of cleaning the stove top, and all of the burners on the stove top with a substantial degree of regularity. The adjacent burners, as well as other, near-by areas of the stove top, inevitably are included in the splattering that takes place during cooking periods.

Since the burners, themselves, whether they be gas or electric, are generally irregular and uneven, and do not have a smooth configuration, it is a rather cumbersome and exasperating job to continually clean them. With respect to gas burners, if material splatters onto an orifice of a gas burner, the orifice may get clogged. The clogging results in problems when that particular burner is later used. When material splatters anywhere onto a cooking unit, either an electric unit or a gas unit, the inevitable result, when that particular burner is next used, is a generally unpleasant burning odor, and a baked-on situation that increases the difficulty in cleaning the burner.

A solution to the problems discussed above is to simply cover the unused burners of a stove while cooking is being accomplished, whether the cooking is on one burner or on more than one burner. Different types of covers are shown in the prior art.

An example of covers for a range is disclosed in U.S. Pat. No. 1,000,185. The '185 patent discloses a folding or hinged double panel cover for a stove. One panel may be folded away from, or off, a pair of burners, thus allowing one or both burners to be used. With the cover folded off the burners, two of the burners are protected from splattering. However, the construction of the cover in the '185 patent limits the access to at least two of the burners when one-half, or one panel, is folded open. The alternative is to have both panels of the cover folded open, thus presenting all four burners for use.

Another example of prior art covers is disclosed in U.S. Pat. No. 1,947,554. The '554 patent discloses a folding panel for a stove top. The cover is made of a plurality of panels and the panels may be arranged in several different ways with respect to the top of the stove. However, as with the '185 patent, a minimum of two burners is uncovered any time one of the panels is folded to allow operation of the top of the stove.

U.S. Pat. No. 2,157,608 also discloses a pair of doors or panels secured to the top of a stove. The doors or panels pivot rearwardly, and each panel covers two burner units. Thus, as with the above-described patents, if only a single burner is to be used, a single panel is opened which exposes at least two burners.

U.S. Pat. No. 2,185,275 discloses a stove with four individual covers for the burners. The covers are not connected together, but rather are separate, individual elements. With the apparatus of the '275 patent, each burner may be selectively uncovered for use at any time, leaving the remainder of the burners covered and thus protected.

Another type of folding panel for a stove top is disclosed in U.S. Pat. No. 2,333,199. The apparatus of the '199 patent discloses a pair of double panels which pivot rearwardly and hinge upon themselves to cover or uncover selectively one-fourth of the stove top. The front portions of each cover are first used or folded, exposing only the front portion of the stove. To use a back or rear burner, both the front and the rear burners must be exposed.

U.S. Pat. No. 2,696,812 discloses another type of panel system for covering the top of a stove. The panel system includes two separate panels, a first panel and a second panel. The second or rear panel is hinged to the rear of the stove and pivots upwardly thereon. The front panel is hinged to the rear panel, and pivots relative to the rear panel, thus uncovering the front part of the stove. The '812 apparatus includes other features, not pertinent to the present invention. However, it will be noted that, as with the other patents discussed above, except for the '275 patent, each burner of the stove is uncovered in a predetermined manner, with the rear burners uncovered last, and, if it is desired to use one or both of the rear burners, the front burners must also be uncovered and thus exposed.

The primary difference between the patents discussed above and the apparatus of the present invention, with all of the patents discussed herein, except the apparatus of the '275 patent, is that the prior art requires the uncovering of at least a pair of burners at one time, regardless of the intent of the user to use only one of the burners. The apparatus of the present invention overcomes the problems of the prior art by allowing a user to selectively uncover a burner, as desired. Any one of four burners on the top of a stove may be used at any time while the remaining three burners remain covered and thus protected. Moreover, the apparatus of the present invention allows the burner covers to be cleaned with minimum difficulty by easily removing the covers from the stove. The prior art apparatus is secured to the stove and pivots or folds in a fixed direction. The apparatus of the present invention allows the selective covering and uncovering of any of the burners on a stove.

SUMMARY OF THE INVENTION

The invention described and claimed herein comprises a stove burner cover having four cover elements secured together and pivotable from a closed position covering all four burners on the top of a stove to a closed, nested position which exposes three burners and which cover apparatus may be easily removed from the stove top for cleaning purposes or for uncovering all four burners on the top of the stove.

Among the objects of the present invention are the following:

To provide new and useful stove top cover apparatus;

to provide new and useful apparatus for covering the burners of a stove;

to provide new and useful apparatus for selectively covering any burner on a stove top;

to provide new and useful cover apparatus for selectively covering the burners on the top of a stove;

to provide new and useful cover apparatus selectively removable from the top of a stove burner; and to provide new and useful cover apparatus for a stove that is easily removed from the stove top for cleaning purposes.

DESCRIPTION OF THE PREFERRED EMBODIMENT

Figure 1:
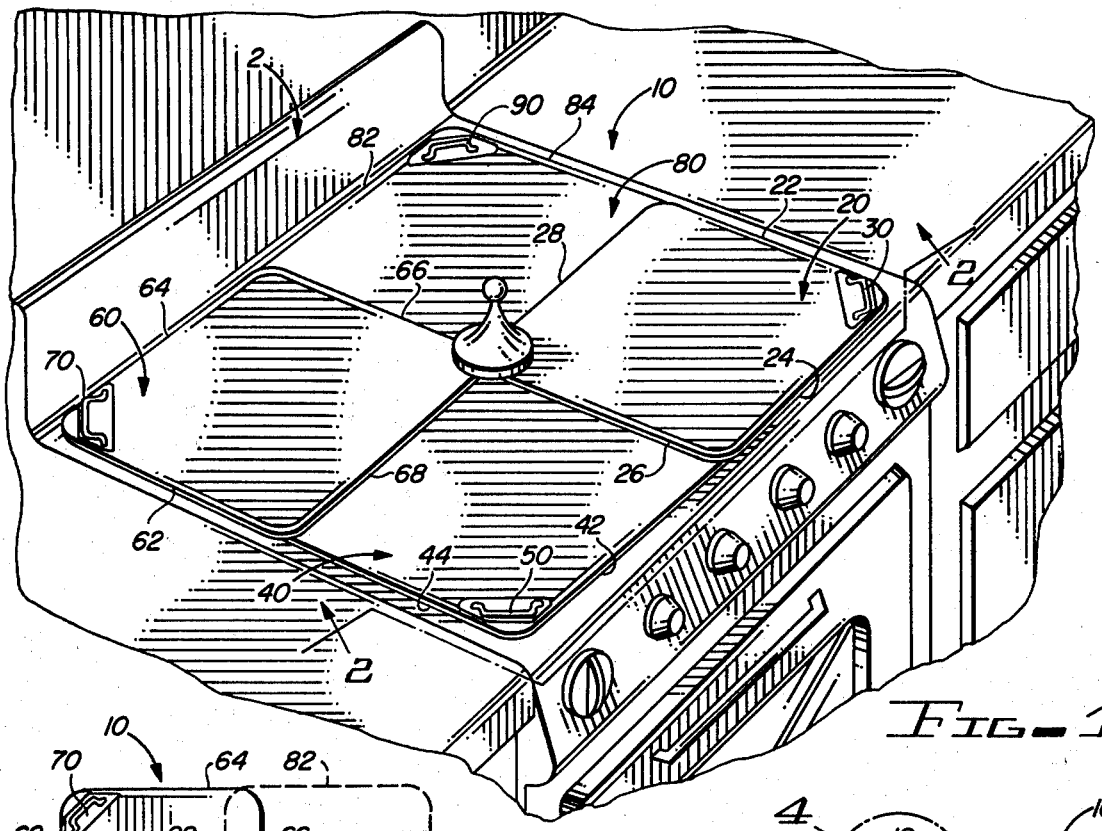
FIG. 1 is a perspective view illustrating the apparatus of the present invention in its use environment.
Figure 3:
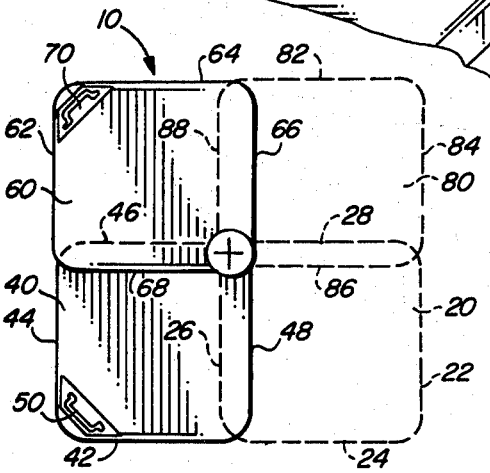
FIG. 3 is a top view of the apparatus of the present invention illustrating the use of part of the apparatus.
Figure 2:
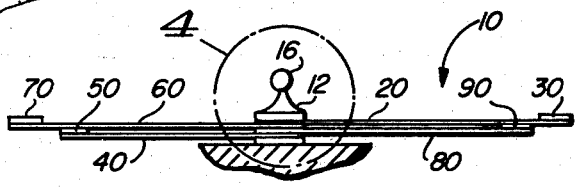
FIG. 2 is an elevational view of the apparatus of the present invention taken generally along line 2—2 of FIG. 1.

FIG. 1 is a perspective view of a stove 2 having a plurality, namely four, of burners covered by burner cover apparatus 10 of the present invention. The cover apparatus 10 is shown in FIG. 1 in its full open position, covering all four burners of the stove 2. FIG. 2 is an elevational view of the burner cover apparatus 10 taken generally along line 2—2 of FIG. 1, illustrating the elements of the burner cover apparatus 10 connected together. FIG. 3 is a top view of the burner cover apparatus 10 showing two elements of the apparatus with two additional elements illustrated in dotted line. The two elements shown cover two separate burners, while the additional two elements, shown open in dotted line (phantom), may be folded or nested with the two elements shown, thus uncovering two burners of a stove.

Figure 4:
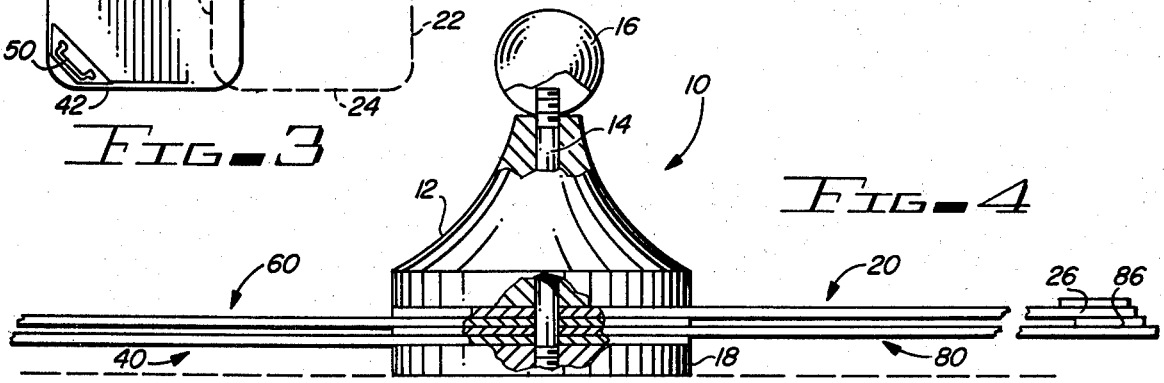
FIG. 4 is an enlarged side view of a portion of the apparatus of the present invention.

FIG. 4 is an enlarged view of a portion of the burner cover apparatus 10 taken generally from circle 4 of FIG. 2, illustrating details of how the four elements of the burner cover apparatus 10 are secured together. For the following discussion, reference will be made primarily to FIGS. 1, 2, 3, and 4.

The burner cover apparatus 10 includes four cover elements or plates 20, 40, 60, and 80. The elements or plates 20 . . . 80 are each generally square in configuration and they are secured together at a central location. As is obvious from FIGS. 1 and 3, the four cover elements or plates 20 . . . 80 are all substantially the same size. The central location is generally at a common corner in the center of the apparatus 10 when the elements or plates are disposed in their generally square or open configuration, such as shown in FIG. 1. For pivoting or nesting purposes, the four elements or plates are secured together at one of their corners, in an overlapping manner, to allow for the independent pivoting movement of each of the four plates with respect to the common corner or location at which the elements are secured together. In order to cover four burners on the top of the stove, which four-burner configuration is a typical arrangement for the tops of both electric and gas stoves, each of the four plates 20 . . . 80 includes a pair of adjacent inner edges which overlap or underlap similar edges on adjacent plates, and two adjacent outer edges which are spaced apart diagonally from the overlapping edges, as best shown in FIG. 1. That is, of the four edges of the plate, two adjacent edges are considered as inner edges and the other two edges are considered outer edges. The inner edges are in an overlapping-/underlappiing relationship with the inner edges of the two adjacent plates or cover elements.

The plate 20 includes a pair of outer edges 22 and 24, which outer edges are not overlapping with adjacent elements. Rather, the outer edges are open, facing outwardly, away from the stove 2. The plate 40 includes a pair of outer edges 42 and 44, which are generally comparable to the edges 22 and 24 of the plate 20. The edges 24 and 42 of the plates 20 and 40, respectively, are generally aligned with each other, as shown in FIG. 1.

The plate 60 includes a pair of outer edges 62 and 64, and the plate 80 includes a pair of outer edges 82 and 84. The edges 44 and 62 of the plates 40 and 60, respectively, are aligned with each other, and the edges 64 and 82 of the plates 60 and 80, respectively, are similarly aligned with each other. The edges 84 and 22 of the plates 80 and 20, respectively, are also aligned with each other.

The aligned edges of adjacent plates define the four outer peripheral edges of the burner cover apparatus 10 when it is in its open position, such as shown in FIG. 1.

Disposed adjacent to the juncture of the outer edges for each plate is a handle. The handles are located adjacent to the "outer" corners of the plates, defined by the outer edges of the plates. Diagonally across each plate from its respective handle is the common or inner corner, or pivot point, and the securing point at which the plates 20, 40, 60, and 80 of the burner cover apparatus 10 are secured together. As best shown in FIG. 4, the plates are secured together in a stacked relationship at their inner corners. The term "inner" is used to define the common point at which the plates 20 . . . 80 are secured together. The term "outer" is accordingly used to define the corner of each plate at which the handles are secured to the plates. The "outer" corner thus being the corner defined by the two outer edges of each plate, as discussed above, and the inner or common corner being defined by the inner edges.

Each plate also includes what is referred to as the inner edges, or edges which are lapping, either above or below, adjacent plates. The lapping or inner edges are shown in FIG. 1 and in FIG. 3, with some of the edges in FIG. 3 shown in dotted line or phantom. Plates 20 and 80, and their outer and inner edges, are outlined in phantom in FIG. 3. For plate 20, its inner edges comprise edges 26 and 28; for plate 40, its inner edges include edge 46 and edge 48; for plate 60, its inner edges include edges 66 and 68; and for plate 80, its inner edges include edges 86 and 88. The overlap or underlap situation of the edges is illustrated in FIGS. 1 and 3.

At the common corner of each of the four plates 20 . . . 80, which is the center of the apparatus 10 when the apparatus is in its opened configuration, as shown in FIG. 1, the plates are secured together by a pin or bolt 14 which extends from a base 18 (see FIG. 4) disposed beneath the plates, upwardly through a hole or aperture in each of the plates, as best shown in FIGS. 2 and 4. The pin or bolt 14 extends from the plates 20 . . . 80 through a center stanchion 12, which is of a generally decorative nature, and to a knob 16 disposed above the center stanchion 12. The primary purpose of the center stanchion 12, and the knob 16 which is disposed on the top of the stanchion 12, is for convenience in holding or moving the appartus 10. The stanchion 12 is configured in the shape of a generally inverted cone to be both decorative and functional.

As may be determined from FIGS. 1, 2, and 4, the plate 40 is the lowermost plate, disposed directly on the base or center piece 18, and the plate 80 is disposed on top of the plate 40. Plate 60 is in turn disposed on top of plate 80, and the plate 20 is the uppermost plate, disposed on top of plate 60. As will be understood, the plates are relatively large and are not inflexible, thus allowing them to bend, etc., to fit on top of the stove in their open position, such as shown in FIG. 1. The four plates 20 . . . 80 are relatively loosely secured by the bolt or pin 14 between the base 18 and the stanchion 12 and its surmounted knob 16 to allow the plates to move both vertically and rotationally for folding purposes without placing undue stress on the plates themselves. The relatively loose connection between the plates 20 . . . 80 thus allows freedom of movement and the use of the plates whether one, two, or three of them are to be folded, as desired, to both cover a portion of the stove top and to uncover the desired burner(s) on the top of the stove.

Referring to FIG. 3, it will be understood how the overlapping of the "inner" edges of each plate provides protection for the entire surface of the stove when all four plates are in their open position, or for the covered portion of the stove when one or more of the plates is folded away from a portion of the stove to uncover a particular burner. The arrangement of the four cover plates, secured together in a stacked relationship, allows any one or more of the cover plates to be folded away from a particular burner regardless of the location or of the combination of burners which it is desired to use. For example, referring still to FIG. 3, if it is desired to uncover the burners beneath plates 20 and 80, plates 20 and 80 are simply pivoted away from their position as shown in FIG. 1 to overlie and underlie, respectively, the plates 40 and 60, as shown in FIG. 3. In the alternative, if it is desired to uncover only a single burner, any one plate may be pivoted in either of two directions to either overlie or underlie, as the case may be, an adjacent plate. Indeed, all of the four plates 20 . . . 80 may be stacked in a single location, thus allowing three burners to be exposed, and providing a cover for only one of the burners. The plates 20 . . . 80 are independently pivoted or moved to selectively cover or uncover any burner.

It will be noted that the cover apparatus 10 is not secured to the top of the stove, but is merely disposed thereon. Accordingly, the cover apparatus 10 may be removed entirely from the burners of a stove and disposed at any convenient location either in its open position, as shown in FIG. 1, or in a partly open, partly closed configuration such as shown in FIG. 3, or in a "closed" position with all four plates stacked on top of each other (not shown). The provision of a handle at the outer corner of each plate, diagonally remote from the common corner of the plate where the plates are secured together, allows each individual plate to be moved (pivoted) easily. The plate 20 includes a handle 30, the plate 40 includes a handle 50, the plate 60 includes a handle 70, and the plate 80 includes a handle 90. The handles also may aid in the lifting or positioning of the entire cover apparatus 10, or selectively in the lifting or positioning of any one or more plates. The securing of the handles may be purely functional, as shown in FIGS. 5 and 6, or they may be of a more decorative nature, such as indicated in FIGS. 1 and 3.

Figure 5:
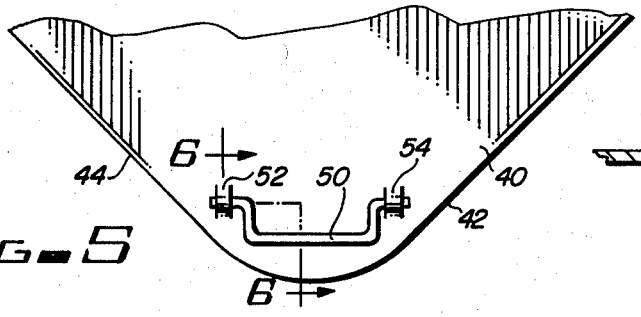
FIG. 5 is a top fragmentary view of a portion of the apparatus of the present invention.

FIG. 5 is a top view of the outer corner of the plate 40, showing the juncture of the outer sides 42 and 44 and the handle 50 disposed adjacent to the juncture of the sides 42 and 44. It will be noted that the outer corner, or the juncture of the sides 42 and 44, is gently rounded to avoid sharp corners. This is done for both aesthetic and practical reasons.

Figure 6:
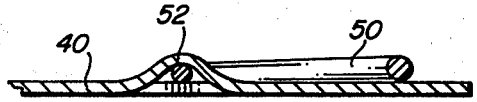
FIG. 6 is a view in partial section of a portion of the apparatus of FIG. 5, taken generally along line 6—6 of FIG. 5.

FIG. 6, which is a view in partial section of the plate 40 of FIG. 5, taken generally along line 6—6 of FIG. 5, illustrates the securing of the handle 50 to the plate 40. The securing is accomplished by simply inserting the handle 50 between a pair of upraised portions of a plate 40 which define a pair of fastening ridges 52 and 54 in the plate 40. As shown in FIG. 6, the handle 50 is thus disposed between the plate 40 and the securing ridges, of which a ridge 52 is shown in FIG. 6. The ridges 52 and 54, together with the adjacent portions of the plate 40, define a pivot or swivel point which both secures the handle 50 to the plate and allows the handle 50 to move freely in pivoting through an arc of 180° on the plate 40. The ridges 52 and 54 are each raised portions of the plate 40 between a pair of parallel cuts in the plate. The handle 50 may be a bent wire ball with its outer ends disposed in the ridges 52 and 54 for holding and pivoting purposes. The handle 50 may, if desired, be of a more decorative nature than a single wire bail, such as a cast metal handle, or the like.

In FIGS. 1, 2, and 4, four plates are shown as comprising the cover apparatus 10. Most typically, there are four burners on a stove top which are disposed in a regular, symmetrical pattern with the burners disposed adjacent to each other. In FIG. 3, two cover plates 40 and 60 are shown, with two plates, 20 and 80, in phantom. In the above discussion, the illustration of FIG. 3 was discussed in terms of four plates, with two of the plates nested and two of the plates covering a stove top. However, the embodiment of FIG. 3 may also illustrate an alternate embodiment of the apparatus of the present invention.

There are some stove tops in which two burners are disposed on one side of the stove top and two other burners are disposed on the opposite side of the stove top, with a counter space between or separating the two sections of burners. For use on a stove top with the burners separated into two sections, with a counter between them, the four-plate apparatus of FIGS. 1, 2, and 4 may not be necessary, but two burner cover units, such as shown in FIG. 3, may be employed. Each burner portion of such alternate embodiment would include two cover plates, such as the cover plates 40 and 60 shown opened in FIG. 3. Thus, instead of four cover plates, only two cover plates are used to cover each burner section. Each burner section may have one or both of its burners covered, or uncovered, as desired. For covering or uncovering any one burner, the two-plate cover is simply folded with its plates disposed on an over/under or stacked relationship. The central stanchion, such as the stanchion 12 and its knob 16, is then disposed in the center of one edge of the two-plate unit, but at a common corner of the two plates, rather than in the center of the four-burner cover unit 10, as discussed above. For convenience, the outer corners of each of the two plates will still include handles, all as discussed above and as illustrated in the drawing.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Stove cover apparatus for covering burners on a stove top having a plurality of burners, comprising, in combination:

plate means, comprising a plurality of plates of substantially the same size for covering the plurality of burners; and fastening means for securing the plurality of plates of the plate means together at a common location whereby each plate of the plate means pivots independently of any other plate for selectively covering and uncovering any one or more of the plurality of burners on the stove top.

2. The apparatus of claim 1 in which the plate means includes a first plate, a second plate, a third plate, and a fourth plate.

3. The apparatus of claim 2 in which each plate of the plate means includes a pair of inner edges which are disposed in a lapping relation to the inner edges of each adjacent plate when the plates are covering the burners of the stove.

4. The apparatus of claim 3 in which the fastening means includes a pin for securing the plates of the plate means together.

5. The apparatus of claim 3 in which the pair of inner edges defines an inner corner of each plate, and the inner corners of the plates define the common location at which the plates are secured together.

6. The apparats of claim 5 in which each plate of the plate means includes an outer corner diagonally opposite from its inner corner.

7. The apparatus of claim 6 in which each plate of the plate means includes a handle at its outer corner.

* * * * *